US008407958B2

(12) United States Patent
Kelly

(10) Patent No.: US 8,407,958 B2
(45) **Date of Patent: *Apr. 2, 2013**

(54) WIND AND WATER RESISTANT BACK WRAP ROOF EDGE TERMINATION

(76) Inventor: Thomas L. Kelly, Waterbury, CT (US)

( * ) Notice: Subject to any disclaimer, the term of this patent is extended or adjusted under 35 U.S.C. 154(b) by 479 days.

This patent is subject to a terminal disclaimer.

(21) Appl. No.: 11/433,987

(22) Filed: May 15, 2006

(65) Prior Publication Data

US 2007/0261346 A1 Nov. 15, 2007

(51) Int. Cl.
*E04B 5/00* (2006.01)

(52) U.S. Cl. ..... 52/409

(58) Field of Classification Search ..... 52/408, 52/58, 79.1, 409, 410, 94, 309.4, 309.7, 746.1, 52/746.11, 745.06
See application file for complete search history.

(56) References Cited

U.S. PATENT DOCUMENTS 1,722,988 A * 7/1929 Waddington ..... 52/246
2,137,889 A * 11/1938 Gillett ..... 52/58
2,164,790 A * 7/1939 Smith ..... 52/419
2,857,861 A * 10/1958 Trostle ..... 52/94
3,483,664 A * 12/1969 Malone, Jr. et al. ..... 52/309.6
3,533,201 A * 10/1970 Tyler ..... 52/60
3,585,766 A * 6/1971 Jamieson ..... 52/60
3,680,269 A * 8/1972 Fischer et al. ..... 52/94
3,735,538 A * 5/1973 Ramins ..... 52/94
3,735,540 A * 5/1973 Thaler ..... 52/94
3,763,605 A * 10/1973 Freeman ..... 52/58
4,037,372 A * 7/1977 Patry ..... 52/96
4,112,632 A * 9/1978 Simpson ..... 52/11
4,155,203 A * 5/1979 Wolma ..... 52/60
4,241,549 A * 12/1980 Hall et al. ..... 52/60
4,335,557 A * 6/1982 Morton ..... 52/745.05
4,389,826 A * 6/1983 Kelly ..... 52/410
4,403,458 A * 9/1983 Lolley ..... 52/60
4,419,850 A * 12/1983 Butzen ..... 52/60
4,439,956 A * 4/1984 House ..... 52/60
4,445,306 A * 5/1984 Schauffele ..... 52/410
4,483,112 A * 11/1984 Rueblinger ..... 52/94
4,493,175 A * 1/1985 Coppola, Jr. ..... 52/410
4,530,193 A * 7/1985 Ochs ..... 52/408
4,557,081 A 12/1985 Kelly ..... 52/94
4,598,507 A * 7/1986 Hickman ..... 52/94
4,641,476 A * 2/1987 Webb et al. ..... 52/60
4,649,686 A * 3/1987 Backenstow et al. ..... 52/509
4,662,129 A * 5/1987 Hickman ..... 52/96
4,674,253 A * 6/1987 Young ..... 52/404.2
4,712,348 A * 12/1987 Triplett et al. ..... 52/408
4,719,723 A * 1/1988 Van Wagoner ..... 52/15
4,736,561 A * 4/1988 Lehr et al. ..... 52/410
4,759,157 A * 7/1988 Webb et al. ..... 52/60
4,780,995 A * 11/1988 Gittins ..... 52/60
4,780,999 A * 11/1988 Webb et al. ..... 52/96
4,870,796 A * 10/1989 Hart et al. ..... 52/409
5,088,259 A * 2/1992 Myers ..... 52/410
5,181,353 A * 1/1993 Harrington, Jr. ..... 52/79.1

(Continued)

*Primary Examiner* — William Gilbert
*Assistant Examiner* — James Ference
(74) *Attorney, Agent, or Firm* — Cantor Colburn LLP

(57) ABSTRACT

Disclosed herein is an assembly that relates to a roof assembly comprising, at least one first waterproof membrane for covering a building roof and a stiff member sealed within at least one second waterproof membrane. The stiff member being substantially aligned with a perimeter of the building roof, and the first waterproof membrane being sealedly attached to the second waterproof membrane. The stiff member being attached to a structure of the building by a plurality of fasteners.

24 Claims, 12 Drawing Sheets

U.S. PATENT DOCUMENTS 5,212,927 A * 5/1993 Sheahan ..... 52/741.4
5,311,716 A * 5/1994 Houssin ..... 52/410
5,319,908 A * 6/1994 Van Erden et al. ..... 52/410
5,349,804 A * 9/1994 Van Erden et al. ..... 52/746.11
5,406,765 A * 4/1995 Brown ..... 52/409
5,469,671 A 11/1995 Rathgeber et al. ..... 52/58
5,584,153 A * 12/1996 Nunley et al. ..... 52/410
5,605,020 A * 2/1997 Chambers ..... 52/58
5,720,147 A * 2/1998 Wenrick et al. ..... 52/745.06
5,740,647 A 4/1998 Kelly ..... 52/408
5,784,845 A * 7/1998 Imeokparia et al. ..... 52/408
5,784,846 A * 7/1998 Godschalx ..... 52/409
5,884,446 A * 3/1999 Hageman ..... 52/408
6,006,482 A * 12/1999 Kelly ..... 52/409
6,021,616 A * 2/2000 Mayle ..... 52/408
6,092,344 A * 7/2000 Kelly ..... 52/410
6,108,981 A * 8/2000 Sama et al. ..... 52/60
6,108,993 A * 8/2000 Hageman ..... 52/408
6,167,660 B1 * 1/2001 Sama ..... 52/58
6,209,283 B1 * 4/2001 Folkersen ..... 52/746.11
6,401,424 B2 * 6/2002 Folkersen ..... 52/746.11
6,427,404 B1 * 8/2002 Hageman ..... 52/309.4
6,505,455 B1 * 1/2003 Georgeau ..... 52/746.11
6,764,260 B1 7/2004 Nebesnak et al. ..... 411/82
6,845,590 B1 * 1/2005 Mills, Jr. ..... 52/60
6,871,472 B2 * 3/2005 Folkersen ..... 52/746.11
6,912,813 B2 * 7/2005 Grizenko ..... 52/58
6,912,814 B1 * 7/2005 Inzeo et al. ..... 52/60
6,922,951 B1 * 8/2005 Inzeo et al. ..... 52/94
6,945,005 B2 * 9/2005 Nunley ..... 52/650.3
7,454,876 B2 * 11/2008 Kelly ..... 52/746.11
2001/0010141 A1 * 8/2001 Folkersen ..... 52/746.11
2002/0170254 A1 * 11/2002 Ritland et al. ..... 52/408
2002/0178671 A1 * 12/2002 Gembala ..... 52/302.6
2005/0126099 A1 6/2005 Kelly ..... 52/412
2006/0010808 A1 * 1/2006 Kelly ..... 52/409
2006/0053702 A1 * 3/2006 Kelly ..... 52/90.1
2006/0053717 A1 * 3/2006 Kelly ..... 52/408
2006/0053718 A1 * 3/2006 Kelly ..... 52/409

* cited by examiner

WIND AND WATER RESISTANT BACK WRAP ROOF EDGE TERMINATION

BACKGROUND OF THE INVENTION

Roofing systems of buildings with low pitch or flat roofs typically use waterproof membranes to prevent water from entering into the building. Large sheets of such membranes are welded or glued to one another, depending on the material of the membrane, to form continuous sheets that cover the entire surface of the roof.

Membranes require termination of one kind or another at least at a perimeter edge of the roof. Because the perimeter edge of the roof is an area that experiences forces that act in different directions as well as being an area where wind vortices create low pressure regions, the roof is prone to expansion and contraction as well as wind failure in this area. Parapet walls and sheet metal gutters, gravel stops and fascia finishes can leak in this area damaging conventional perimeter membrane terminations. Typical edge termination practices such as; nailers, termination bars, reinforced membrane strips and fasteners are prone to failure for mainly two reasons: first, the pulling of the membrane due to high winds eventually tears the membrane at the stress concentration points created by the small discrete or non-uniform areas of membrane retention; and second, moisture finds its way to the boards in which the retaining features are embedded, causing rotting that eventually results in the fasteners coming loose from the boards. Once the membrane is no longer retained at the perimeter of the roof, winds can easily peal it away allowing water from rain and snow to enter the building through the unprotected roof.

Accordingly, there is a need in the art for improvements in retention of waterproof roof membranes, particularly at the perimeter of a roof.

BRIEF DESCRIPTION OF THE INVENTION

Disclosed herein is an assembly that relates to a roof assembly comprising, at least one first waterproof membrane for covering a building roof, a stiff member sealed within at least one second waterproof membrane, the stiff member being substantially aligned with a perimeter of the building roof, and the first waterproof membrane being sealedly attached to the second waterproof membrane. The stiff member being attached to a structure of the building by a plurality of fasteners.

Further disclosed is a system that relates to a hurricane resistant roof perimeter waterproofing system comprising, at least one first waterproofing membrane and at least one second waterproofing membrane being sealed to the at least one first waterproofing membrane. A plurality of stiff members encapsulated by the at least one first waterproofing membrane or the at least one second waterproofing membrane, and a plurality of fasteners that attach the stiff member to a structure of a building.

Further disclosed herein is a method that relates to terminating an edge of a roof waterproofing membrane comprising, covering a building roof with at least one first waterproofing membrane, aligning at least one stiff member along a perimeter of the building roof, and covering the at least one stiff member within a second waterproofing membrane. Further, sealing the second waterproofing membrane to the first waterproofing membrane, and attaching the stiff member to the structure of the building.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
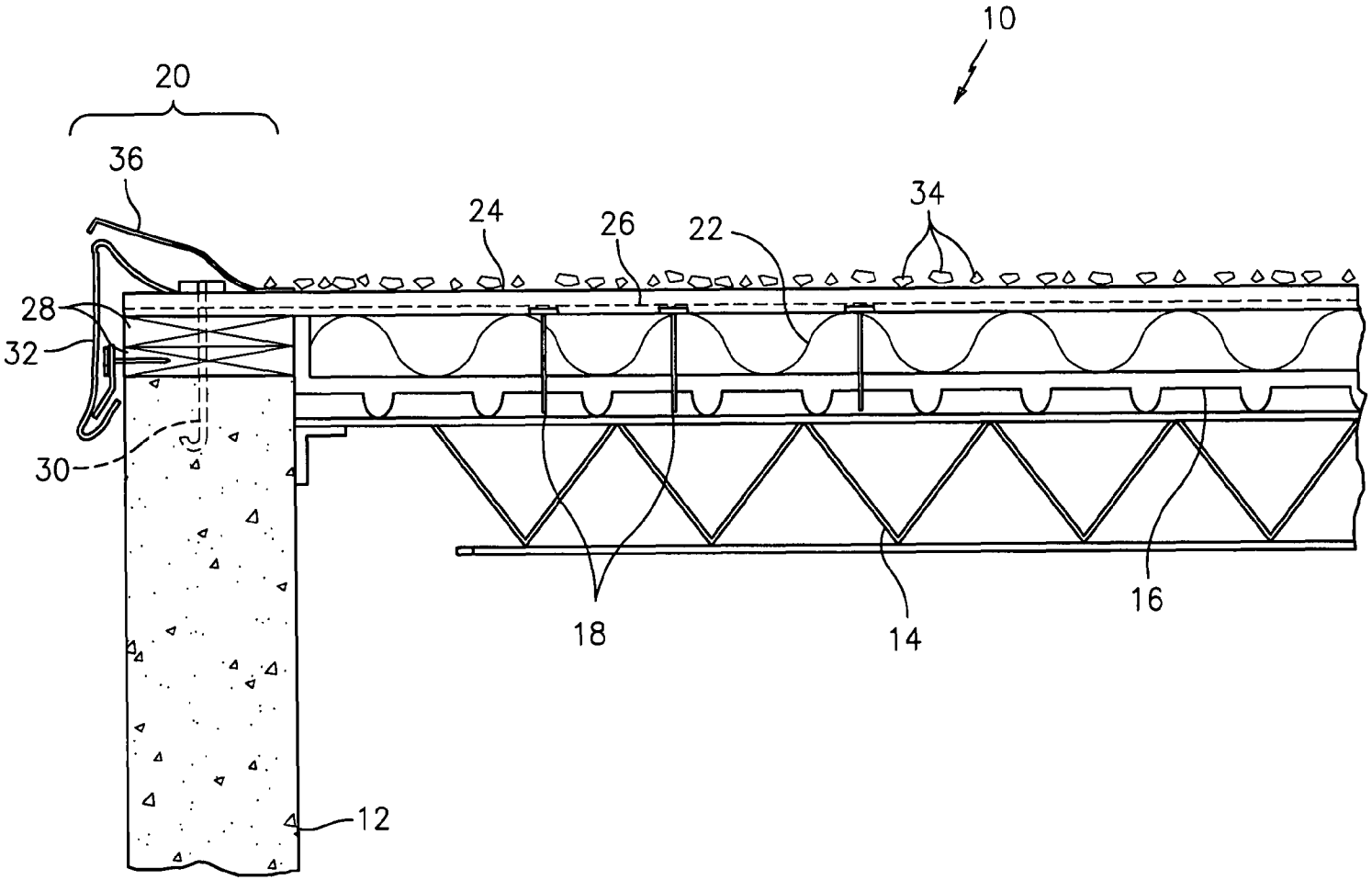
FIG. 1 (PRIOR ART)
FIG. 1 is a cross sectional view of a prior art single ply membrane roof assembly system.

Referring first to FIG. 1, a prior art single ply membrane roof assembly system is generally shown at 10. The structural building wall 12 supports one end of a structural roof beam 14, which for purposes of this disclosure also includes such structural roof members as rafters and joists as well as metal, concrete or the like roof deck panels 16 that are fastened to the structural roof beam 14. Insulation layer 22 is installed or fastened to the roof deck panels 16 by fasteners 18. A field membrane 24 is installed onto insulation layer 22 by means of an adhesive 26. The membrane 24 may be made of ethylene propylene diene monomer (EPDM), chlorosulfonated polyethylene (CSPE), polyvinyl chloride (PVC) or similar roof waterproofing single ply membranes. To complete the installation, wood blocking often referred to as a nailer 28 is used at the perimeter edge of the building 20 anchored to the building wall 12 by fasteners 30 and capped by gravel stop metal edging 32 over which flashing 36 is installed.

Figure 2A:
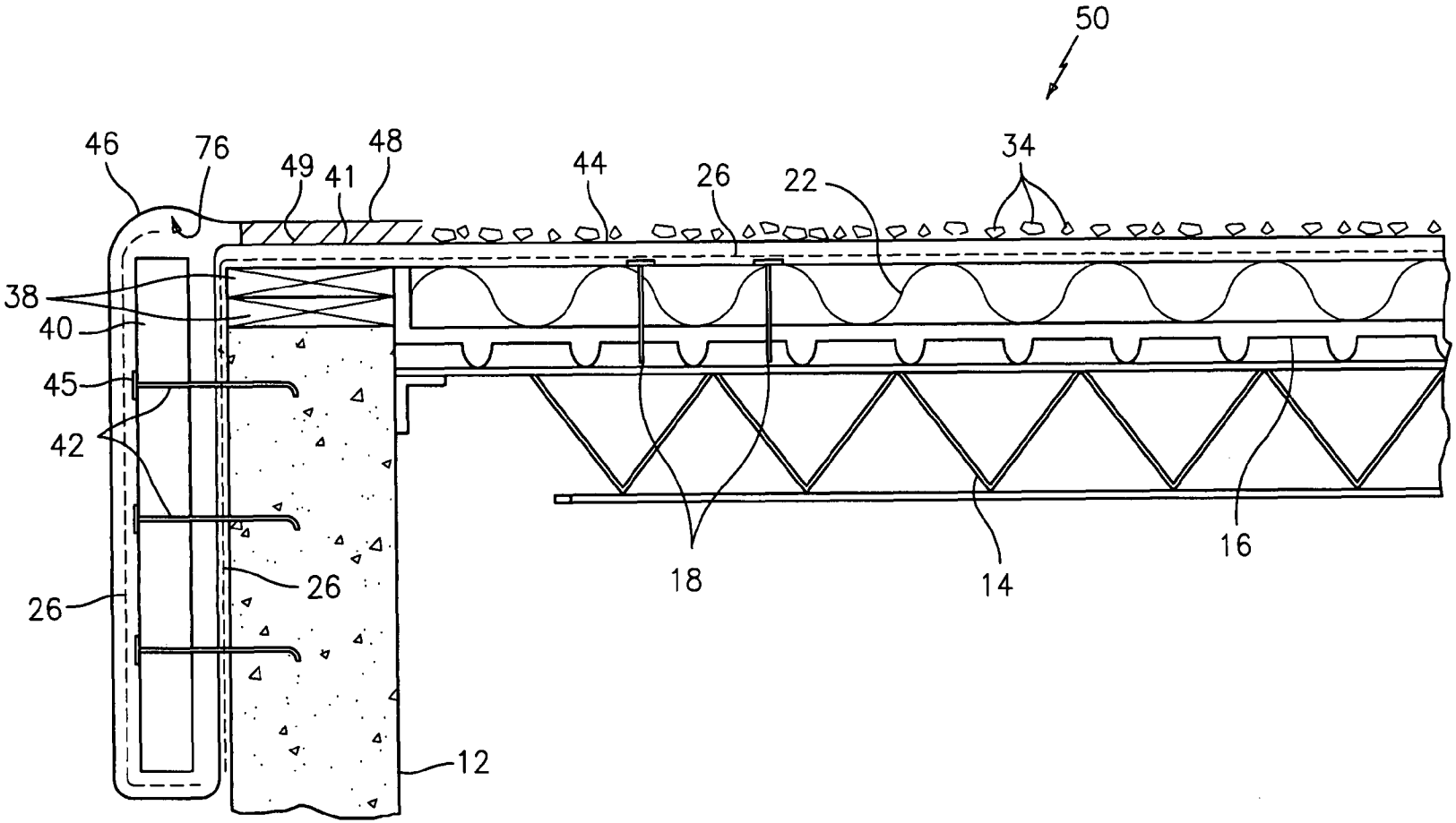
FIGS. 2A and 2B are cross sectional views of a single ply membrane roof assembly system of an embodiment of the present invention used as an original new construction roof in a vertical application.

Referring to FIG. 2A, an embodiment of the present invention used as an original roof is generally shown at 50, which is a partial cross sectional view, that parallels FIG. 1. Structural building wall 12 supports one end of structural roof beam, rafter or joist 14. Metal, concrete or the like roof deck panels 16 are fastened to the structured roof beam 14. The roof insulation panel layer 22 is installed or fastened to the roof deck panels 16 by fasteners 18.

A waterproof field membrane 44 is installed onto roof insulation layer 22 by means of adhesive 26. The membrane 44 extends beyond the wall 12 far enough to have a wrap portion 46 of the membrane 44 back wrap around a stiff member 40 and allow an interior edge 48 to lay back upon a membrane portion 41 of the membrane 44. The interior edge 48 is attached to the membrane portion 41 thereby encapsulating the stiff member 40 within the waterproof membrane 44. The membrane 44 can be attached to itself or another membrane in a number of ways such as solvent welding, heat welding, contact adhesive gluing, or double sided adhesive taping, for example, hereafter referred to as welded or glued 49. The method chosen is the one most suitable for the roof waterproofing membrane chosen. The stiff member 40 is attached to the wrap membrane portion 46 with adhesive 26. Fasteners 42 shown here as nails may also be screws or other elongated retention devices that penetrate the building or roof decking structure, thereby providing a more robust anchoring of the membrane perimeter than is achieved by fastening to a nailer 38 alone. The fasteners 42 in this embodiment attach the encapsulated stiff member 40, which lies flush with a surface of the wall 12, to the building structure of the wall 12. The stiff member 40 lies on a side of the wall 12 opposite a side of the wall 12 in which the roof is positioned. Adhesive 26 is applied between the wrap membrane portion 46 and the wall 12 to prevent moisture ingress at that location and to provide added structural retention of the stiff member 40 and membrane portion 46 to the wall 12.

By sandwiching the membrane portion 46 between the stiff member 40 and the wall 12 the membrane portion 46 is retained uniformly along the length of the wall 12. This uniformity prevents the formation of any local stress risers, which could exceed the strength of the membrane material, resulting in tearing when the membrane portion 46 is pulled as occurs when wind blows up the side and over the roof creating a lower pressure on the upper surface of the membrane 44. Additionally, by being sealed in a waterproof envelope created by the encapsulating membrane portion 46 the stiff member 40 will remain dry; preventing it from rotting. Rotting of perimeter nailers 38 is problematic in that it allows fasteners, that are holding a membrane in place, to break free thereby increasing the load on the remaining fasteners, which results in tearing of the membrane, which can then be easily pealed back exposing the non-waterproof roof components to rain and snow.

In some embodiments of the invention the stiff member 40 may be made of any stiff material including plywood, oriented strand board (OSB), treated lumber, synthetic plastic sheeting, and metal, for example, although non-grained materials have an advantage of resisting splitting. Additionally the stiff member 40 has properties of stiffness such that it holds its shape even while being pulled nonuniformly by attachments to roof and building structures and membranes for example. By holding its shape the stiff member 40 distributes any loads applied to it over the entire body of the stiff member 40 thereby minimizing localized stress levels. Dimensions of six to ten inches in a substantially vertical direction and two to four feet in a substantially horizontal direction are therefore in accordance with the invention however the invention is not limited to these dimensions.

Figure 3A:
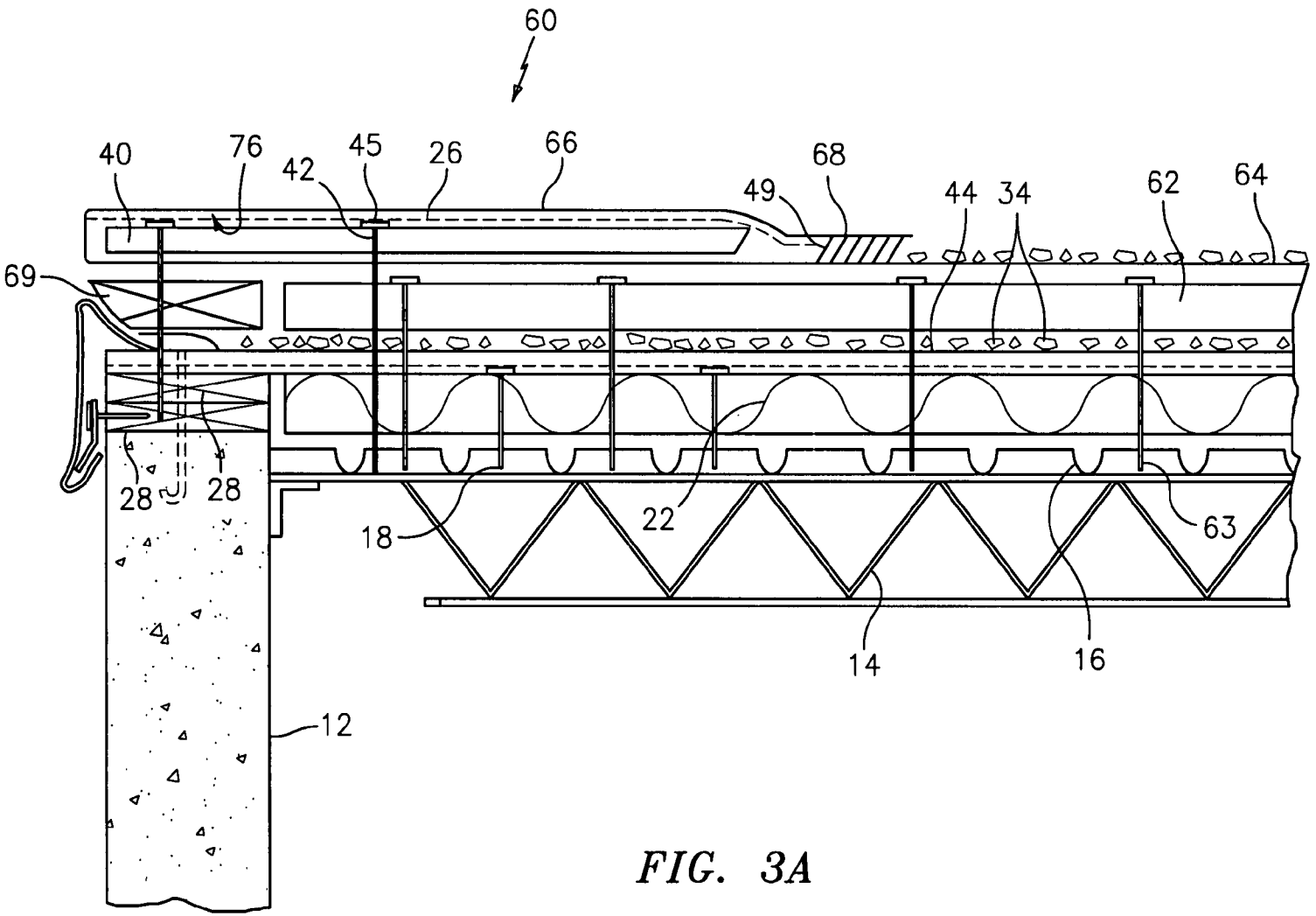
FIGS. 3A and 3B are cross sectional views of a roof assembly system of an embodiment of the present invention used in a re-roofing application in a horizontal application.

Referring to FIG. 3A, an embodiment of the present invention used as a replacement roof is generally shown at 60. As discussed relative to the prior art roof system, structural building wall 12 supports one end of structural roof beam, rafter or joist 14. Metal, concrete or the like roof deck panels 16 are fastened to the structured roof beam 14. Insulation panel layer 22 is installed or fastened to the roof deck panels 16 by fasteners 18.

Figure 4:
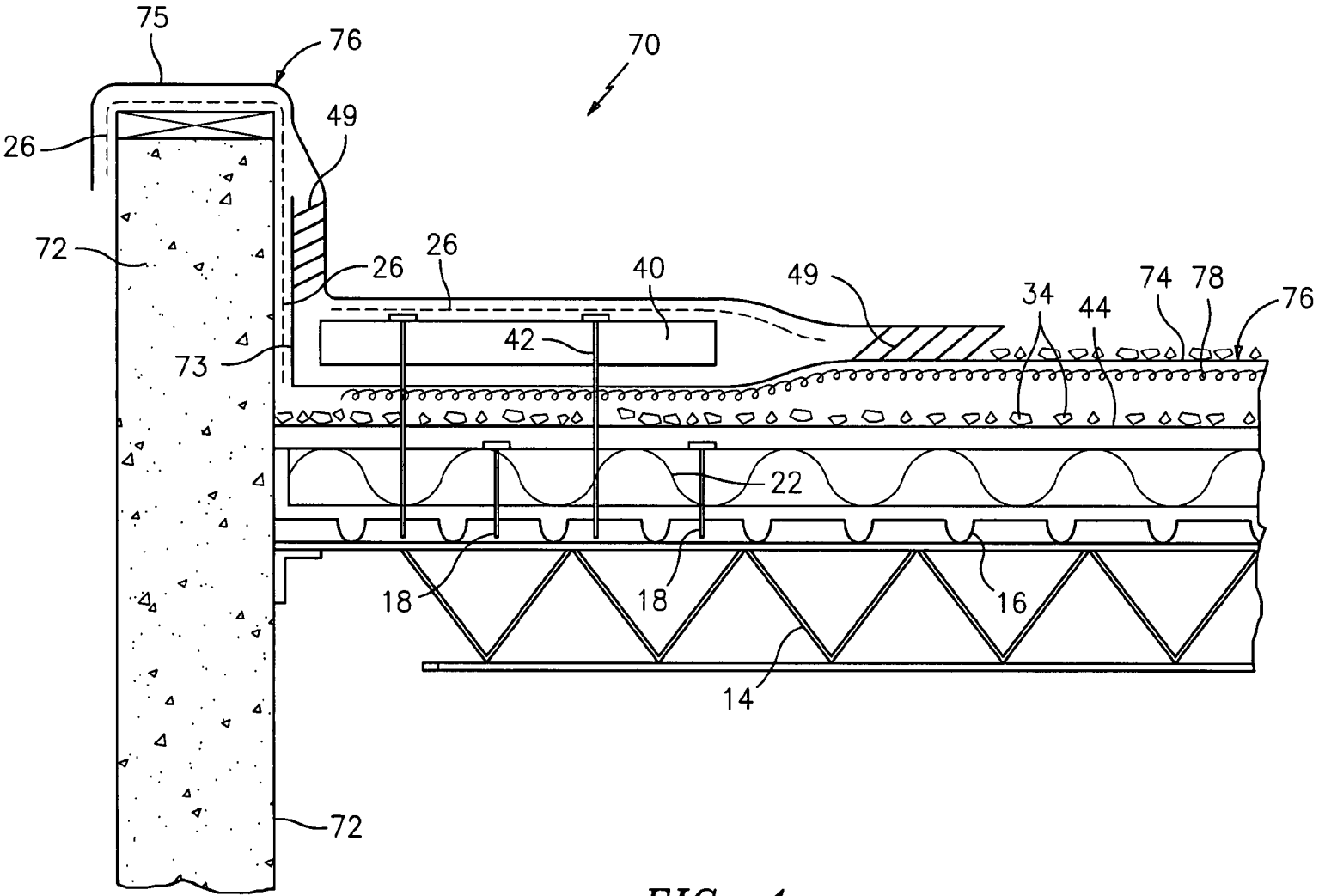
FIG. 4 is a cross sectional view of a roof assembly system of an embodiment of the present invention used on a roof with a parapet wall.

In accordance with an embodiment of the invention, a new membrane referred to as a re-roof membrane 64 is applied over the original roof's field membrane 44. A separation member 62 (or matting-fleece 78 as shown in FIG. 4) is placed over the original roof's field membrane 44 and gravel 34 to protect the re-roof field membrane 64 from damage from below. The separation member 62 is fastened through the insulation 22 and into the roof panels 16 by fasteners 63. Blocking (nailer) 69 is added around the perimeter of the roof 20 to form a level area with the surface of the separation member 62. The re-roof membrane 64 extends beyond the wall 12 and forms a wrap portion 66 of the re-roof membrane 64 that folds over a stiff member 40 and back onto itself at an interior edge 68. The interior edge 68 is welded or glued 49 to the re-roof membrane 64 to form a waterproof encapsulation around the stiff member 40. Adhesive 26 attaches the stiff member 40 with the wrap portion 66 of the membrane 64. Fasteners 42 attach the stiff member 40 and membranes 66, 64 to the building structure of the wall 12 and the roof panels 16. It should be noted that throughout this disclosure the structural members of the building may include any of the following: the wall 12, roof beam 14 and roof panels 16 as described above as well as other embodiments of these structures as described below. Additionally, building members that are not described herein but may serve as a structural portion of the building, for purposes of attaching the stiff member 40 thereto, will also be encompassed by the spirit and scope of embodiments of the present invention.

Figure 2B:
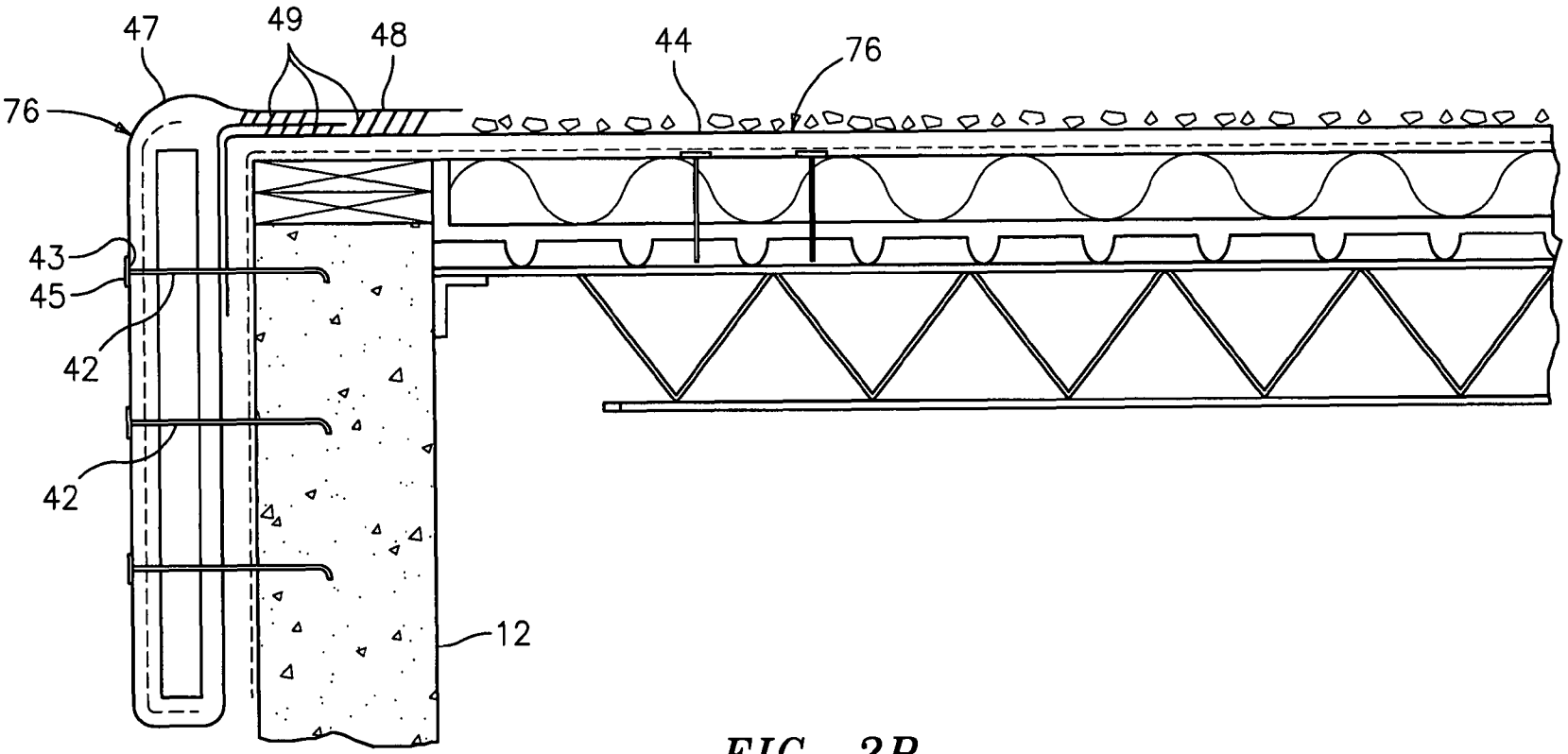

Sealing the stiff member 40 in an encapsulation of membrane material without protrusions therethrough is desirable to minimize water intrusion. However, certain aspects of a roofing structure may make it difficult or impossible. A comparison of FIGS. 2A and 2B effectively illustrate this point. In FIG. 2A the fasteners 42 may be driven through the stiff member 40 prior to welding or gluing 49 the wrap portion 46 to the field membrane 44 thereby permitting fasteners heads 45 to be sealed within the encapsulation. In contrast, in FIG. 2B the stiff member 40 is encapsulated and sealed within a membrane 47 prior to the membrane 47 being welded or glued 49 to the field membrane 44 making it impossible to then apply fasteners 42 without forming holes 43 through the membrane 47. Both methods, however, with the fastener heads 45 within the encapsulation and with fastener heads 42 outside of the encapsulation are within the scope of the invention and may be applied to any embodiments of the invention. Referring to FIG. 4, an embodiment of the present invention applied to a building having a parapet wall is generally shown at 70. As discussed relative to the prior art roof system, structural building wall 12 supports one end of structural roof beam, rafter or joist 14. Metal, concrete or the like roof deck panels 16 are fastened to the structured roof beam 14. Roof insulation panel layer 22 is installed or fastened to the roof deck panels 16 by fasteners 18.

In FIG. 4 wall 12 is a parapet wall 72 that extends in elevation above where the roof deck meets the parapet wall 72. A new membrane referred to as a re-roof field membrane 74 is applied over the original roof's field membrane 44. A layer of matting-fleece 78 (or a separation member 62 as shown in FIG. 3A) is placed over the original roof's field membrane 44 and gravel 34 to protect the re-roof field membrane 74 from damage from below. The re-roof membrane 74 extends beyond the interface between the roof and the parapet wall 72 and folds upward at the interface leaving a protruded re-roof membrane portion 73 that is adhered to the parapet wall 72 with adhesive 26. A stiff member 40 is positioned on top of the re-roof membrane 74 adjacent to the parapet wall 72 such that the protruded re-roof membrane portion 73 is sandwiched between an edge of the stiff member 40 and the parapet wall 72.

A separate piece of membrane material referred to as flashing 75 is draped over the top of the parapet wall 72 and down over the protruded re-roof membrane portion 73, the stiff member 40 and the re-roof membrane 74. The flashing 75 is attached to the stiff member 40 with adhesive 26 and is either welded or glued 49 to the protruded re-roof membrane portion 73 and the re-roof membrane 74 to encapsulate the stiff member 40 inside a waterproof pocket of membrane material. The portion of the flashing 75, which is draped over the parapet wall 72, is attached to the parapet wall 72 with adhesive 26 forming a continuous watertight seal from the outer surface of the parapet wall 72 to the re-roof membrane 74. Fasteners 42 secure the stiff member 40, the membrane 73 and the insulation 22 to the structural roof deck panels 16.

Figure 3B:
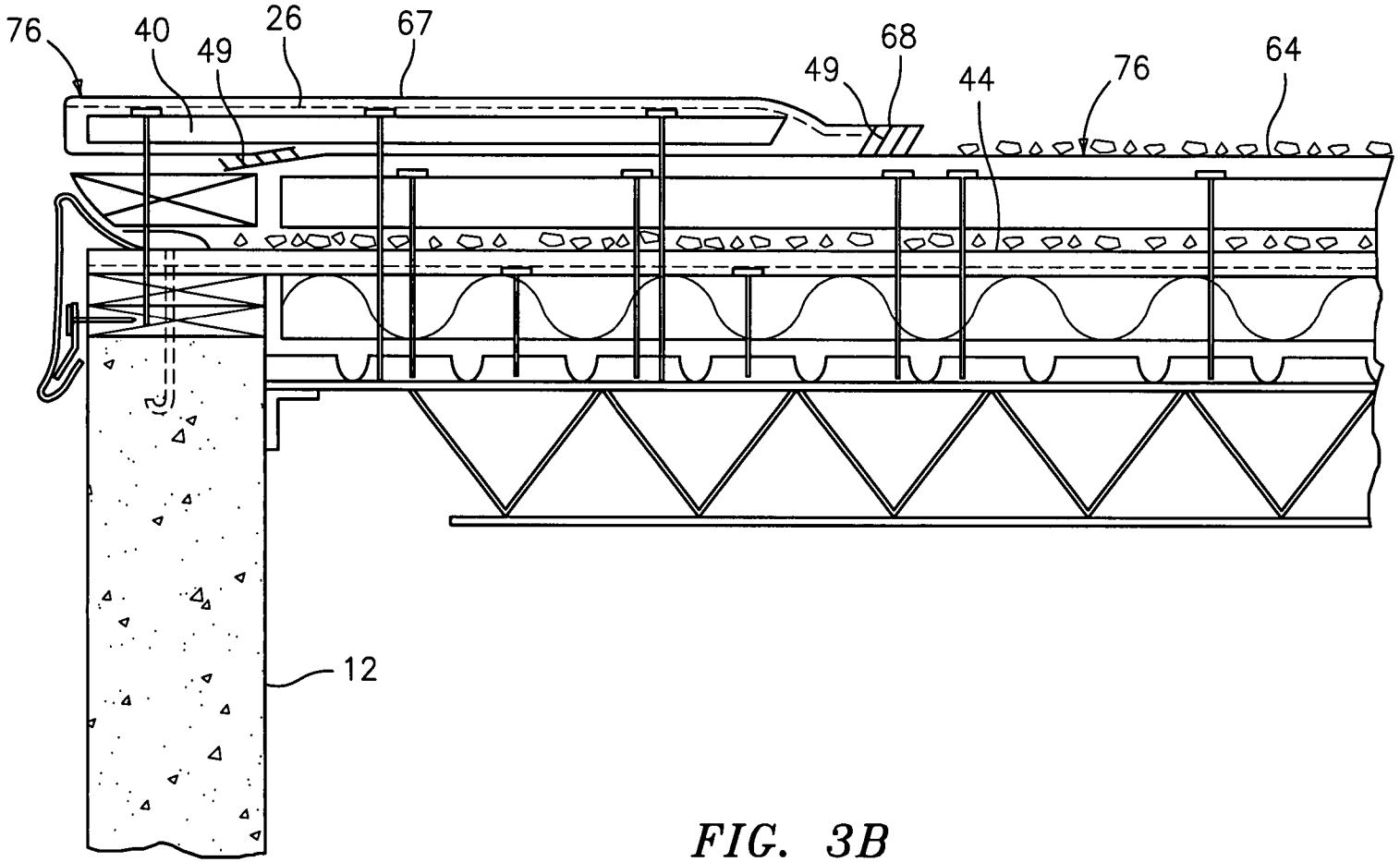

Durability of the membranes to weather conditions is also an item of concern. In order to make the membrane more durable to such conditions some thermoplastic membrane materials are treated with ultraviolet (UV) stabilizers and anti-fungicides, for example. Due to cost reasons such treatments are commonly performed on only one side of the membrane materials, hereafter referred to as the weatherproof side 76, it is sometimes desirable to install membranes with this weatherproof side 76 on the outside. In embodiments of FIGS. 2A and 3A the portions of the thermoplastic membrane 46, 66, which are covering the stiff member 40, and are exposed to the atmosphere are not the weatherproof side 76 of the membranes 46, 66. Since the membranes 44, 64 in these embodiments are one continuous sheet of membrane covering the roof and encapsulating the stiff member 40, then either the portion covering the roof or the portion encapsulating the stiff member 40 must be the side opposite the weatherproof side 76. Embodiments shown in FIGS. 2B and 3B overcome this problem by splicing a reversed layer 47, 67 of the membrane to the perimeter edge of the field membrane 44, 64 such that the weatherproof side 76, of the reversed membrane 47, 67 covering the stiff member 40, is exposed to the atmosphere. Since the embodiment of already uses a separate piece of membrane, namely the flashing 75, to cover the stiff member addressing the issue of having the weatherproof side 76 facing outward is simply accomplished by orienting it in this matter prior to applying it.

Figure 5:
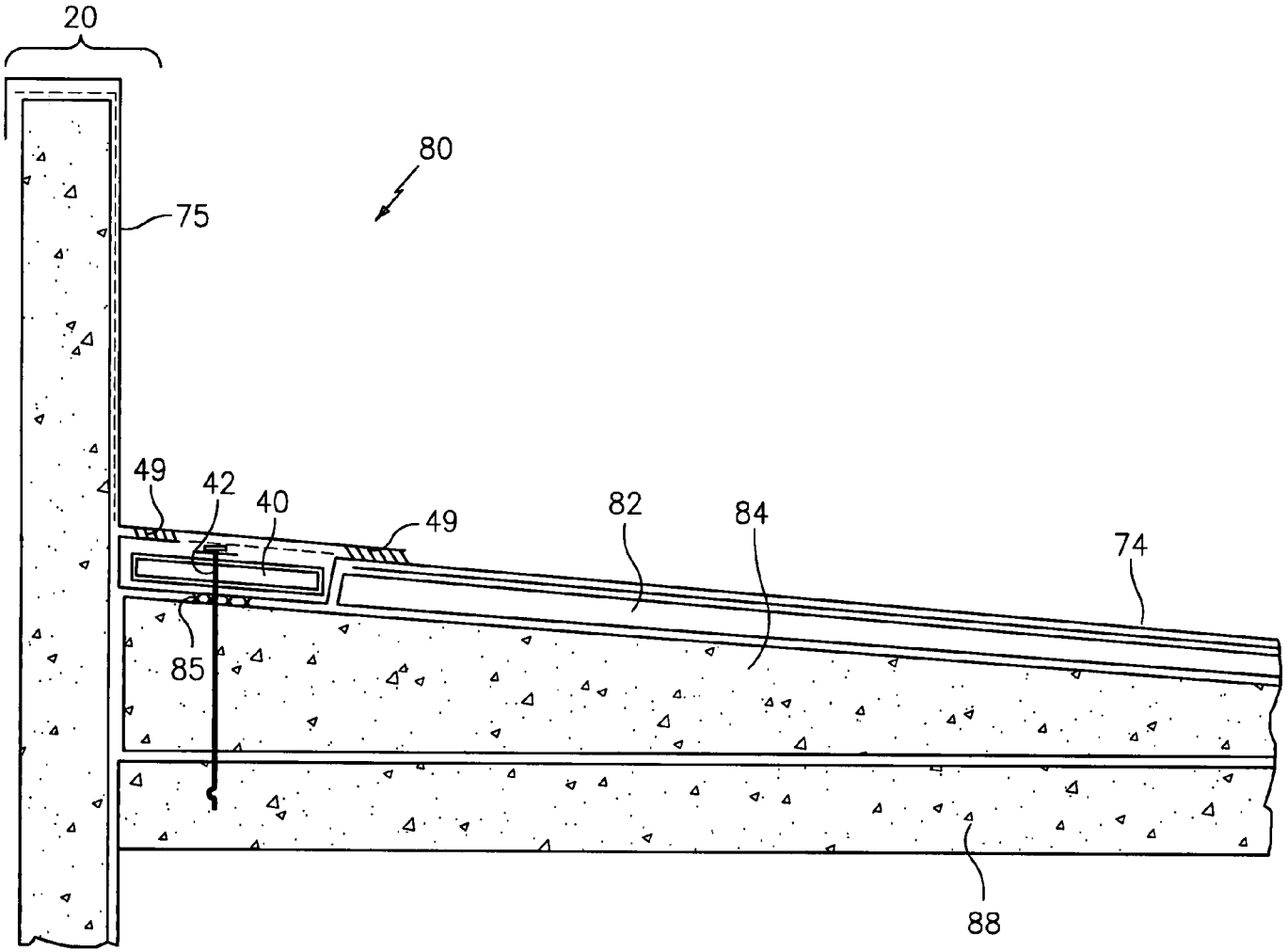
FIG. 5 is a cross sectional view of a roof assembly of an embodiment of the present invention used in a re-roof application over a built up roof assembly.

Referring to FIG. 5, another re-roofing embodiment of the present invention is generally shown as roof assembly 80. As in FIG. 4, the membrane of FIG. 5 is applied over an existing roof assembly. This roof assembly 80 is of a re-roof membrane 74 applied over a built-up-roof (BUR) 82. The re-roof membrane 74 partially wraps around stiff member 40 near the perimeter of the roof 20. The flashing 75, with the weatherproof layer 76 such as an ultraviolet (UV) protection layer for example, facing the atmosphere, covers the remainder of the stiff member 40 and is welded or glued 49 to the re-roof membrane 74 at either end of the stiff member 40. Thus forming a waterproof encapsulation around the stiff member 40. Fasteners 42 attach the stiff member 40 and membrane 74 to the structural layers, specifically through a lightweight concrete layer 84 and into a pour-in-place concrete deck layer 88. The embodiment illustrated in FIG. 5 also shows the present invention applied to a sloped roof assembly 80.

A seal 85 placed between the membrane 74 encapsulating the stiff member 40 and the lightweight concrete 84 prevents the ingress of air and water at that location. Butyl gum or other air and water sealing methods may be employed as seal 85.

Figure 6:
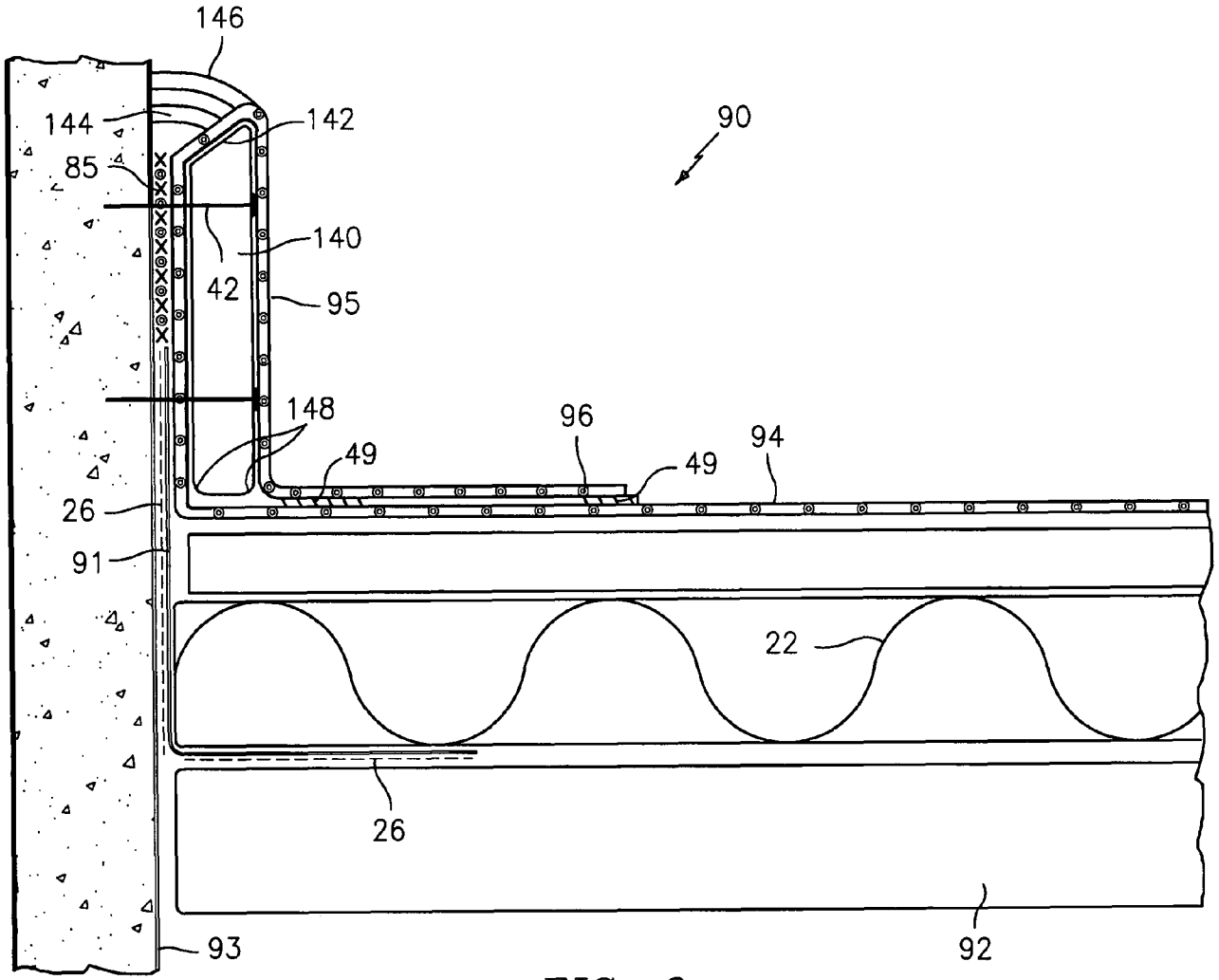
FIG. 6 is a cross sectional view of a roof assembly of an embodiment of the present invention for a roof deck on which fastener penetrations are not desirable.

Referring to FIG. 6, a roof assembly 90 is shown using decking materials 92 that cannot be easily fastened into with typical mechanical fasteners 42. An air seal membrane 91 is applied under the perimeter edge of the insulation 22 and bonded to the structural roof deck material 92 and an abutting wall 93 with adhesive 26. Reversed membrane 95 is wrapped around stiff member 140 and is welded or glued 49 to itself forming an uninterrupted membrane barrier encapsulating the stiff member 140. Fasteners 42 attach the encapsulated stiff member 140, to the structurally sound wall 93, thereby negating the need to fasten into the deck 92. Sandwiched between the wall 93 and the encapsulated stiff member 140 is the air seal membrane 91 and butyl gum type seal 85. The reversed membrane 95 is welded or glued 49 to the field membrane 94. The membranes 94 and 95 depicted here are made of a fiber reinforced 96 PVC thermoplastic.

An angled cut 142 along an edge of the stiff member creates a channel 144 between the wall 93 and the angled cut 142. The channel 144 retains caulking 146 to seal the reversed membrane 95 to the wall 93. In addition, the corners 148 of the stiff member 140 are rounded-off to reduce stress and the potential for tearing of the membrane 95 that could result from a sharp corner.

Figure 7:
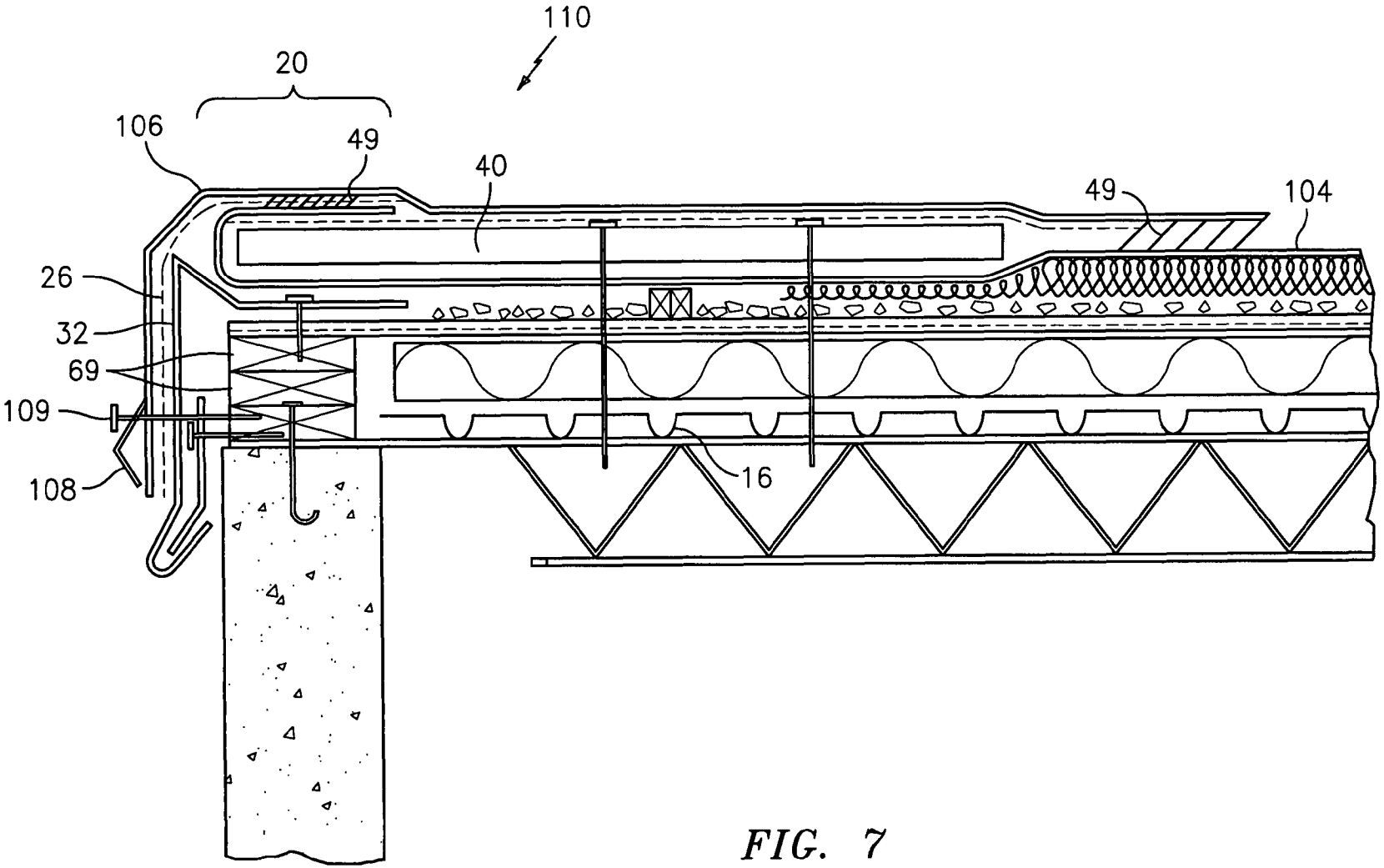
FIG. 7 is a cross sectional view of a roof assembly of an embodiment of the present invention used in a re-roof application similar to that of FIG. 3.
Figure 8:
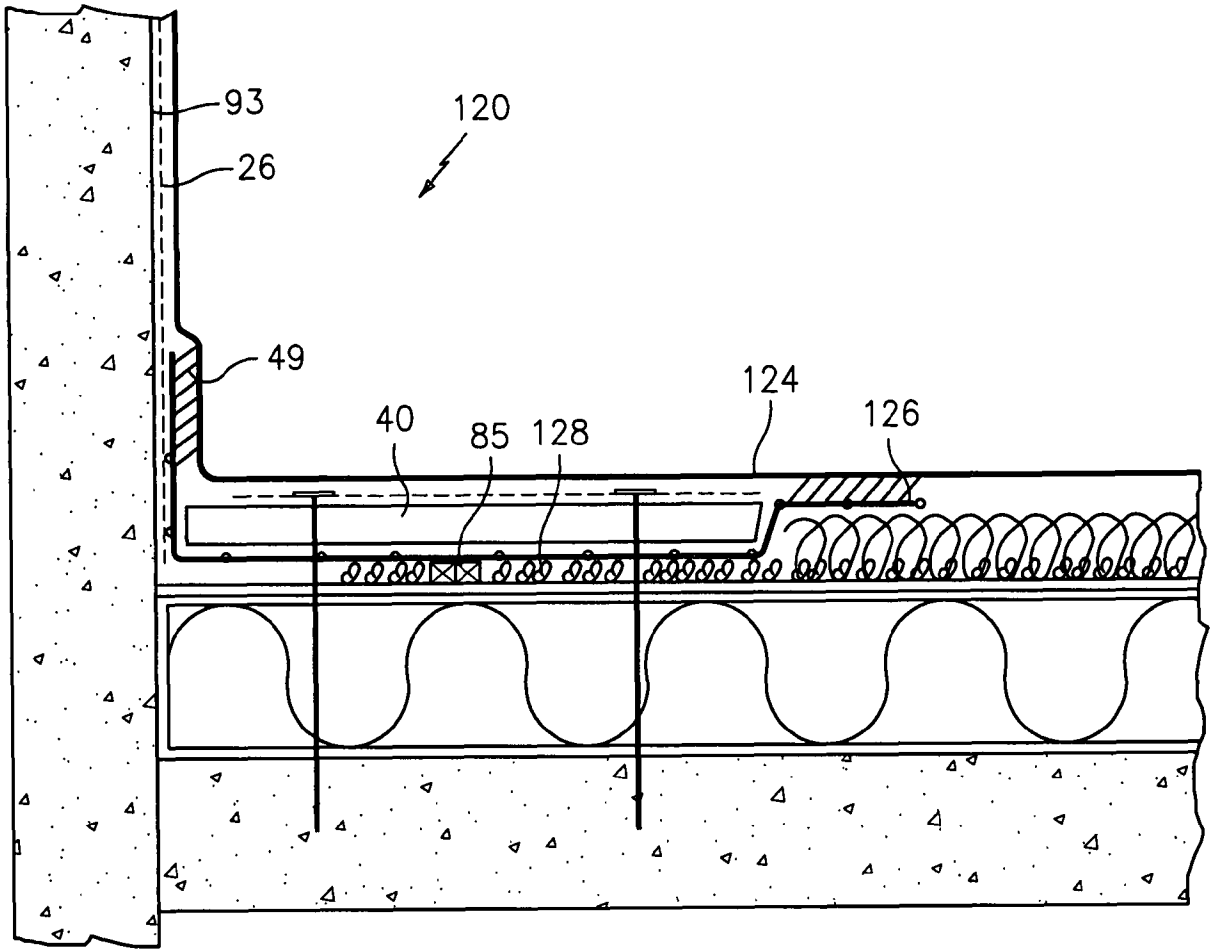
FIG. 8 is a cross sectional view of a roof assembly of an embodiment of the present invention used in a re-roof application similar to FIG. 4.

Referring to FIG. 7, an alternate embodiment of the present invention shown in FIG. 3A is generally shown at 110. Wherein, in FIG. 3A the re-roofing membrane 64 ended at the existing edge of the roof assembly 60, in FIG. 7 a flashing membrane 106 extends over the edge covering the gravel stop 32, thereby preventing the ingress of water between the membrane 106 and the gravel stop 32. Adhesive 26 attaches the membrane 106 to the gravel stop 32 and fasteners 109 attach bracket 108, membrane 106 and gravel stop 32 to the blocking 69. In addition to covering the gravel stop 32 the flashing membrane 106 is welded or glued 49 to the re-roof membrane 104 in two locations to form a waterproof encapsulation around the stiff member 40. Stated another way, the re-roof membrane 104 is extended beyond the perimeter of the roof 20 and terminated by mechanically fastening a stiff member 40 over the membrane 104 and into the roof deck 16. The extension of the membrane 64 beyond the perimeter edge is back wrapped over the stiff member 40 and welded or glued 49 to the flashing membrane 106 to encapsulate the stiff member 40. Referring to FIG. 8, an alternate embodiment of the present invention is generally shown at 120. The field membrane 124 continues from the surface of the roof up the side of the abutting wall 93, where it is sealed and glued with adhesive 26 to the wall 93. A separate piece of membrane 126 is welded or glued 49 to the field membrane 124 on both sides of the stiff member 40 creating a waterproof encapsulation around the stiff member 40. A seal 85 is formed between the existing roof surface 128 and the lower surface of the membrane 126 to create a watertight seal and preventingress of water or air at that location.

Figure 9:
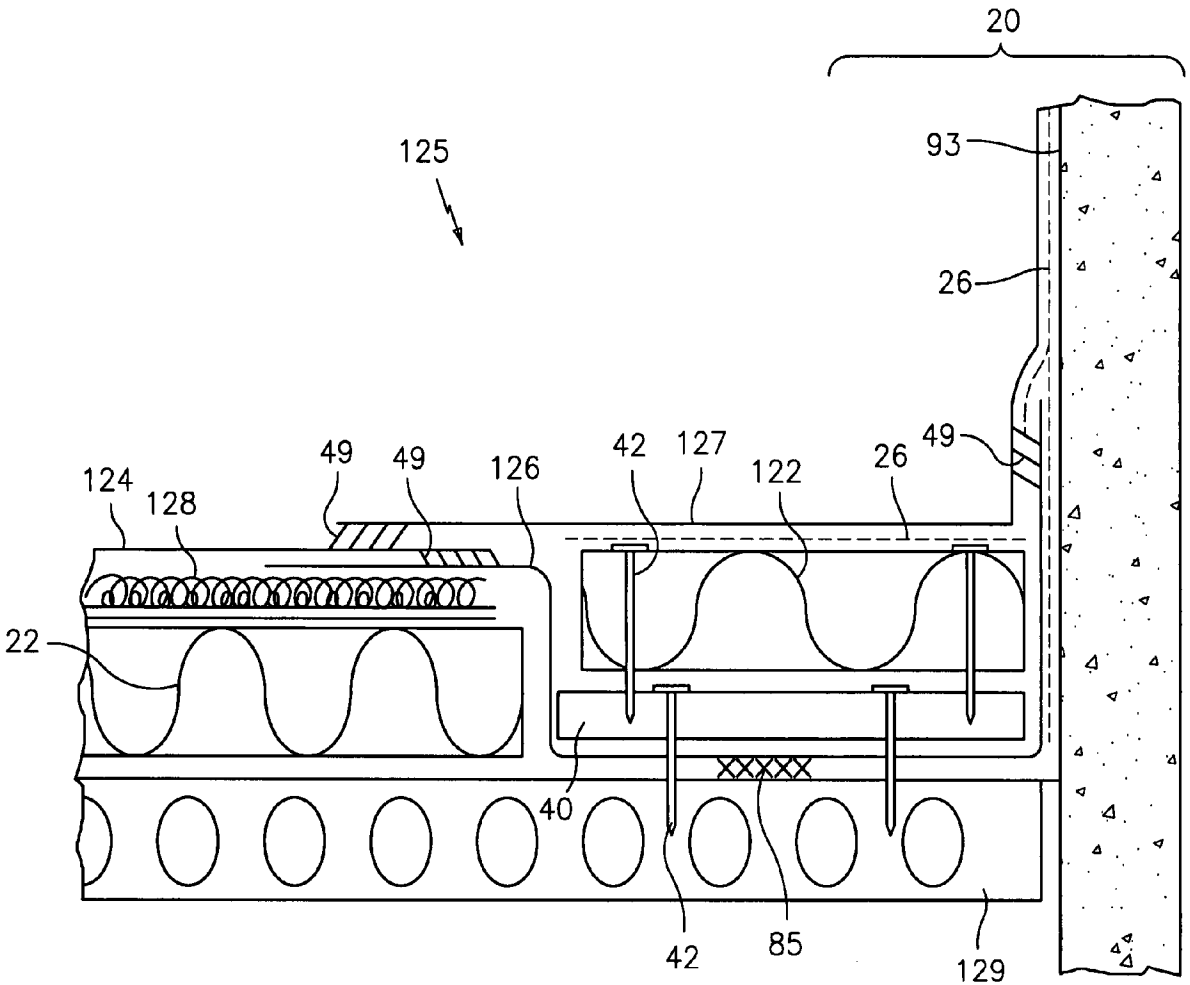
FIG. 9 is a cross sectional view of an alternate embodiment of the invention with an encapsulated stiff member and a piece of rigid roof insulation.

Referring to FIG. 9, an alternate embodiment of the invention is generally shown at 125. The field membrane 124 near the roof perimeter 20 is welded or glued 49 to two other membranes 126 and 127. Membrane 126 extends below the stiff member 40 that is structurally attached to the precast hollow core concrete 129 of the existing roof with fasteners 42. A seal 85 located below the stiff member 40 and between the membrane 126 and the existing roof forms a seal to prevent ingress of air and water. The membrane 126 continues up the abutting wall 93 with one side being attached to the wall 93 with adhesive 26 and the other side being welded or glued 49 to the upper membrane 127 thereby forming an encapsulation of the stiff member with the three membranes 124, 126 and 127. An insulation layer 122 is positioned above and fastened to the stiff member 40 with fasteners 42 and is contained within the encapsulation formed by the three membranes 124, 126 and 127 with the stiff member 40. The upper membrane 127, in addition to being welded or glued 49 to the membranes 124 and 126, is attached to both the wall 93 and to the insulation layer 122 with adhesive 26.

Figure 10:
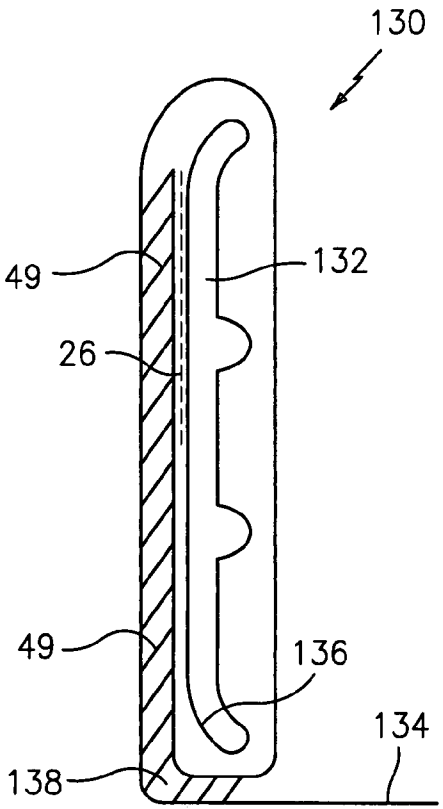
FIG. 10 is a cross sectional view of an alternate embodiment of the present invention of an encapsulated stiff member made of extruded aluminum.

Referring to FIG. 10, an alternate embodiment of an encapsulated stiff member assembly 130 is shown. Encapsulated stiff member 132 is an extruded metal or synthetic plastic sheet with generous radii on edges 136 to reduce stress and prevent tearing of the membrane 134. The membrane 134 is double wrapped around the stiff member 132 at corner 138 where the highest stresses are expected due to wind creating a low pressure cell and lifting the membrane 134. Thus two layers of membrane 134 are provided at corner 138 of stiff member 132 to provide additional tear resistance of the membrane 134. In areas where the membrane is overlapping itself due to the double wrapping it is welded or glued 49 to itself. Adhesive 26 attaches the membrane 134 to the stiff member 132 to prevent the membrane 134 from moving relative to the stiff member 132.

Figure 11:
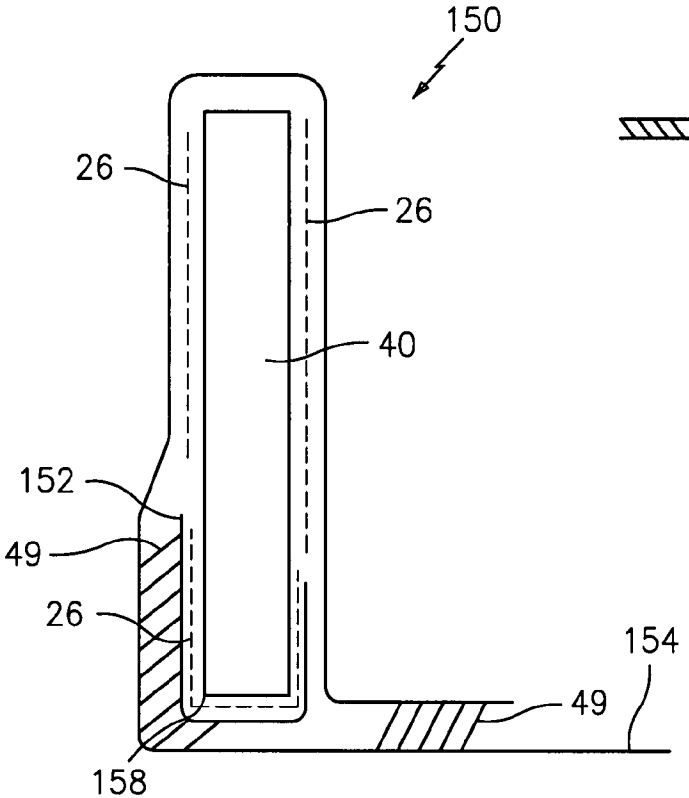
FIG. 11 is a cross sectional view of another embodiment of the present invention of an encapsulated stiff member synthetic board.

Referring to FIG. 11, an alternate embodiment of an encapsulated stiff member assembly 150 is shown. A piece of field membrane 152 is glued around a corner 158 of stiff member 40 with adhesive 26. A field membrane 154 wrapped around and glued to stiff member 40 with adhesive 26 and is welded or glued 49 to itself encapsulating the stiff member 40 within a waterproof encasing of membrane 154. Additionally, the membrane 154 is welded or glued 49 to the field membrane 152 thereby creating a double membrane layer over corner 158. The additional layer of field membrane 152 creates a cushion for the field membrane 154 and thereby distributes any load due to wind lifting the membrane 154 over a wider area. The adhesive 26 attachments of the membranes 154, and 152 to each other and to the stiff member 40 prevent relative movement between the stiff member 40 and membranes 152, 154 thereby preventing abrasion. Embodiments of the invention may use the stiff member encapsulations of FIGS. 10 and 11 alone or in addition to the embodiments of the invention with a field water proofing membrane.

Figure 12:
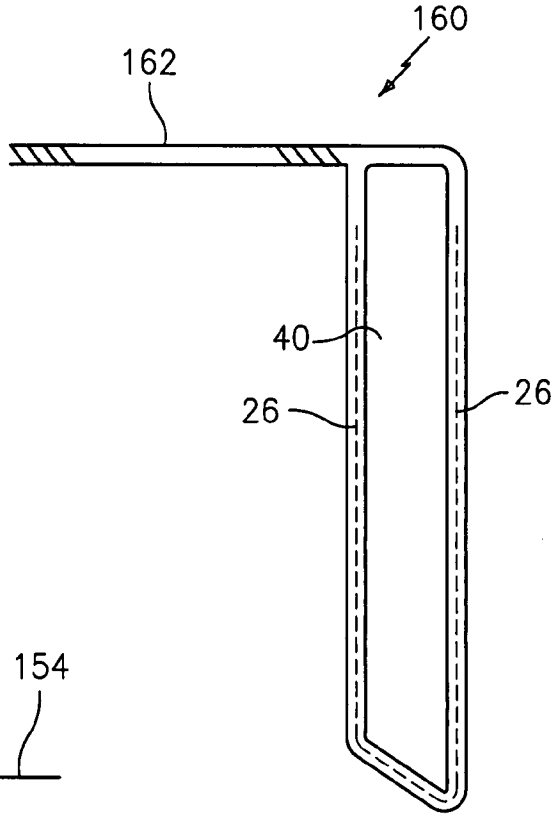
FIG. 12 is a yet another cross sectional view of another embodiment of the invention of an encapsulated stiff member.

Referring to FIG. 12, an embodiment of a universal perimeter edge 160 is shown. A piece of membrane 162 is wrapped around the stiff member 40 and welded or glued 49 to it self thereby encapsulating the stiff member 40 in an air and watertight enclosure. The stiff member 40 is attached to the membrane 162 by adhesive 26 to prevent relative movement between the two components. This universal perimeter edge 162 can be applied to other embodiments of the invention such as that depicted in FIG. 2B for example.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A roof assembly of a building, the roof assembly comprising:

a first waterproofing membrane including at least one first waterproofing membrane portion and at least one second waterproofing membrane portion, wherein the at least one first waterproofing membrane portion is configured for covering a roof of a building, the roof terminating at a distinct edge in proximity to a vertical exterior surface of a wall of the building;

at least one stiff member, disposed upon said first waterproofing membrane portion such that a first surface of said stiff member is adjacent said first waterproofing membrane portion, said second waterproofing membrane portion wrapping back upon said first waterproofing membrane portion to be disposed adjacent a surface of said stiff member that is opposite said first surface, said first waterproofing membrane portion and said second waterproofing membrane portion enclosing said stiff member along at least three sides of said stiff member, a second waterproofing membrane exposed at a top surface to an ambient environment of the roof and including a roof portion and an edge portion, said roof portion being disposed over said second waterproofing membrane portion and said stiff member, said roof portion being welded or glued to said second waterproofing membrane portion at a first attachment point and welded or glued to said first waterproofing membrane portion a second attachment points, said first attachment point and said second attachment point both being disposed at an underside of said roof portion only, wherein said first attachment point and said second attachment point are separated from each other via areas of said underside of said roof portion that are absent any welding or gluing to said second waterproofing membrane portion or said first waterproofing membrane, wherein said edge portion of said second waterproofing membrane extends over said edge of said roof in a downward direction perpendicular to said roof portion such that said edge portion runs downwardly along said vertical exterior surface of the wall of the building, wherein attachment of said roof portion to said second waterproofing membrane portion and said first waterproofing membrane portion at said first and second attachment points creates an enclosed member cavity that fully encapsulates said stiff member, and wherein the first and second waterproofing membranes are more flexible and resilient than the stiff member.

2. The roof assembly of claim 1, wherein:

the at least one first waterproofing membrane portion and the at least one second membrane portion are parts of a single membrane.

3. The roof assembly of claim 1, wherein:

said attachment points are welded or glued.

4. The roof assembly of claim 1, wherein:

the stiff member lies substantially vertical.

5. The roof assembly of claim 4, wherein:

the stiff member lies flush against a wall and the fasteners attach the stiff member to the wall.

6. The roof assembly of claim 5, wherein:

the stiff member is attached to a surface of the wall on a side opposite a side of the wall on which the roof is positioned.

7. The roof assembly of claim 1, wherein:

the at least one waterproof membrane is a single ply membrane.

8. The roof assembly of claim 1, wherein:

the at least one of the waterproofing membrane portions are made of a material selected from the group consisting of ethylene propylene diene monomer, chlorosulfonated polyethylene, and polyvinyl chloride.

9. The roof assembly of claim 1, wherein:

the at least one waterproof membranes are reinforced with a reinforcing material.

10. The roof assembly of claim 1, wherein:

the at least one waterproof membrane covering the stiff member has a first side more weather resistant than a second side, and the first side is oriented to face the atmosphere.

11. The roof assembly of claim 10, wherein:

the first side of the waterproof membrane has enhanced ultraviolet (UV) protection.

12. The roof assembly of claim 1, wherein:

the at least one second membrane is applied in two or more layers over corners of the stiff member.

13. The roof assembly of claim 1, wherein:

the stiff member has rounded corners.

14. The roof assembly of claim 1, wherein:

the stiff member is selected from the group consisting of treated lumber, plywood, oriented strand board, synthetic plastic sheeting, and metal.

15. The roof assembly of claim 1, wherein:

the stiff member holds its shape under nonuniformly distributed stresses.

16. The roof assembly of claim 1, wherein:

the at least one first membrane is the waterproof layer for a newly constructed roof.

17. The roof assembly of claim 1, wherein:

the at least one first waterproofing membrane portion is used to re-roof an existing roof.

18. The roof assembly of claim 1, wherein:

the roof is sloped or substantially horizontal.

19. The roof assembly of claim 1, wherein:

the stiff member is substantially aligned with penetrations in the roof.

20. The roof assembly of claim 1, wherein:

the stiff member is substantially parallel to a surface of the roof.

21. The roof assembly of claim 1, wherein:

the stiff member is substantially perpendicular to a surface of the roof.

22. The roof assembly of claim 1, wherein:

the stiff member is fastened to a parapet wall.

23. The roof assembly of claim 1, wherein:

the stiff member is fastened to an abutting wall.

24. The roof assembly of claim 1, wherein said stiff member and said at least one first waterproofing membrane portion are affixed to the roof via mechanical fasteners.

* * * * *